United States Patent [19]

Patry et al.

[11] Patent Number: 4,669,809

[45] Date of Patent: Jun. 2, 1987

[54] OPTICAL AIMING ASSEMBLY, FOR DESIGNATING AND FOR TRACKING A TARGET

[75] Inventors: Philippe Patry, Bagneux; Jean-Claude Roy, Fresnes, both of France

[73] Assignee: Societe de Fabrication d'Instruments de Mesure, Massy, France

[21] Appl. No.: 743,142

[22] Filed: Jun. 10, 1985

[30] Foreign Application Priority Data

Jun. 15, 1984 [FR] France ..... 84 09391

[51] Int. Cl.[4] ..... G01C 3/08

[52] U.S. Cl. ..... 350/1.1; 356/1; 356/5

[58] Field of Search ..... 350/1.1, 1.2, 1.3, 1.4, 350/6.4; 340/870.29; 356/5, 8, 1, 16, 19

[56] References Cited

FOREIGN PATENT DOCUMENTS 2475208 8/1981 France .

*Primary Examiner*—Bruce Y. Arnold

*Attorney, Agent, or Firm*—Stevens, Davis, Miller & Mosher

[57] ABSTRACT

The assembly comprises a laser emitter (100), localization means (200) for providing data on the angle between a target and a projectile, an aiming block (300) enabling an operator to aim at the target optically, and collimator means (400) enabling the operator to center the target in the field of view. In accordance with the invention, harmonization means (500), e.g. a crossed-prism deflector (501, 502) interposed between the collimator means and the aiming block, are provided to adjust the angular orientation of the collimation direction in such a manner as to cause said direction ($O_7 D_7$) to coincide with the reference ($A_2 B_2$) or aiming ($A_1 B_1$, $C_1 D_1$) direction, i.e. with the direction corresponding to the real aiming and designation direction to the target, and also with the localization direction ($J_3 K_3$), i.e. the direction in which the localization means sees the designated target.

3 Claims, 1 Drawing Figure

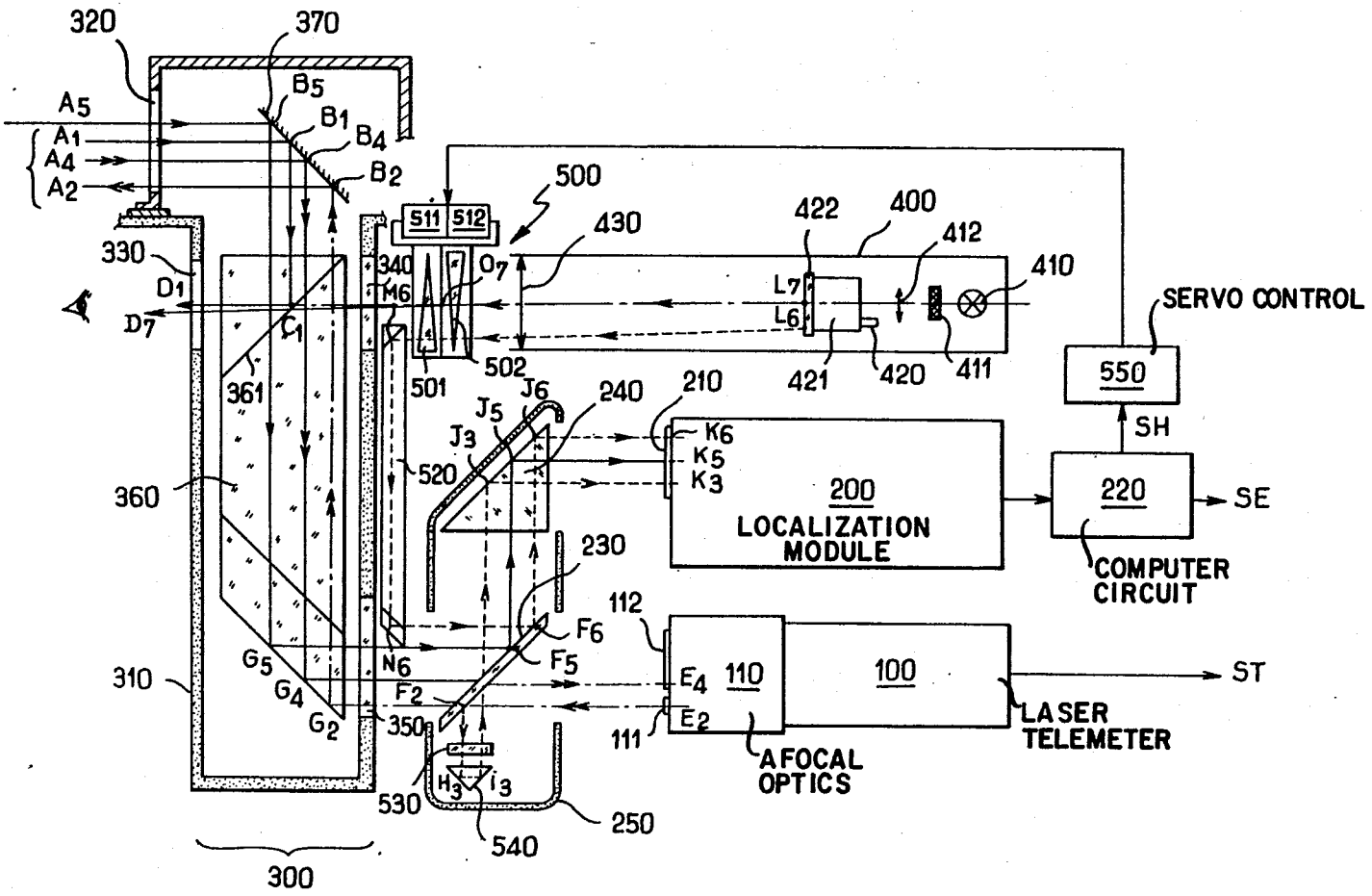
SERVO CONTROL
550
SH
220
COMPUTER CIRCUIT
SE
ST
LASER TELEMETER
100
AFOCAL OPTICS
110
200
LOCALIZATION MODULE
410
411
412
400
420
421
422
L7
L6
K6
K5
K3
210
E4
E2
112
111
240
230
250
F6
F5
J6
J5
J3
540
I3
H3
500
430
502
O7
S11
S12
501
520
340
M6
N6
F2
350
530
B2
B4
B1
B5
370
C1
361
G2
G4
G5
300
320
A5
A1
A4
A2
330
D1
D7
360
310

OPTICAL AIMING ASSEMBLY, FOR DESIGNATING AND FOR TRACKING A TARGET

The invention relates to an optical aiming assembly for designating and tracking a target.

BACKGROUND OF THE INVENTION

Assemblies of this type serve to designate a target by means of a laser emitter (generally a telemeter) whose radiation (which is generally infrared radiation) is directed by an operator towards the target which the operator observes and tracks by the optical aiming means. More generally, a collimator is provided suitable for forming a visible image of a reticle which represents the aiming direction and which is superposed on the image of the target, such that the reference direction (i.e. the direction in which the laser telemeter is pointing) coincides with the aiming direction when the image of the target is placed in the middle of the reticle.

When a projectile is fired at the target, the radiation of its tracer is received and directed to an angle measuring device (also referred to herein as "localization means"). The angle measuring device also receives a signal representative of the direction to the target, thus defining a "localization direction" which is the direction in which the localizing means "imagines" the target to be found (except for the case in which a laser emitter also serves as an illuminator no radiation returned from the target is directly available to the localization means). The relative position in three dimensions between the two input directions is determined and the localization means derives an angular difference signal representative of the angular difference between the direction to the projectile and the localization direction (which ideally coincides with the direction to the target as designated by the laser beam, i.e. with the reference direction). This information can subsequently be used to remotely control the projectile so that its trajectory is directed to the target direction.

Further, the laser emitter generally co-operates with telemetry means which additionally receive the radiation reflected from the target in order to derive a telemetry signal representative of the distance to the target and, where applicable, a signal representative of the relative speed of the target, said data being derived from the propagation time of the return laser pulse.

One of the difficulties encountered with this type of device lies in ensuring that the reference or aiming direction (i.e. the real direction to the target), the direction indicated by the collimator reticle (hereinafter designated "the collimator direction" which is the apparent direction to the target as seen by the eye of the operator), and the localization direction (which is the theoretical direction to the target as taken into consideration by the localization means) all coincide. When the operator aims at a target, it is essential that the center of the reticle corresponds very exactly with the reference and localization directions. If this condition is not satisfied the distance-measuring and angle-measuring means will be operating on a point which differs to a greater or lesser extent from the point occupied by the target.

Techniques for performing this adjustment or "harmonization" already exist in the prior art.

When the aiming is performed by purely electronic means (with the aiming field being projected onto a flying spot cathode tube or the like, and with the target being automatically tracked), it is possible to perform such harmonization by modifying the flying spot scan. One such harmonization technique is described, for example, in published French patent specification No. 2 475 208.

The present invention is concerned with the case where aiming is performed by purely optical means using a reticle, i.e. where it is the operator himself who designates the target by centering it in the collimator and who tracks the target in his field of view.

In such a case, the difficulty is increased by the fact that the distance-measuring and angle-measuring assembly (which is an electronic assembly) and the aiming assembly (which is a purely optical assembly) constitute two separate blocks. Harmonization is generally performed by very fine adjustment of the angular position of the beam emitted by the telemeter relative to the aiming block which transmits the beam, thereby presupposing accurate adjustment means and a very rigid mechanical structure for avoiding subsequent loss of alignment.

SUMMARY OF THE INVENTION

To mitigate this difficulty, the present invention provides a novel harmonization means for use in combination with the above-mentioned structure, said structure comprising:

designator means suitable for emitting monochromatic radiation along a reference direction towards a designated target;

an aiming block enabling the target to be observed by an operator along an aiming direction coinciding with the reference direction, and orientable in such a manner as to simultaneously modify said directions to direct them to a target;

collimator means suitable for forming a visible image of a reticle indicative of the aiming direction and for sending said image to the aiming block, in a collimation direction representative of the aiming direction; and localization means suitable for receiving firstly a signal representative of the direction to the target along a localization direction, and secondly radiation emitted by a projectile fired towards the target, and for comparing the respective propagation directions to derive an angle signal relating to the projectile and to the target;

wherein the optical aiming assembly further comprises:

harmonization means interposed between the collimator means and the aiming block and suitable for adjusting the angular orientation of the collimation direction in such a manner as to cause the collimation direction at the outlet from the aiming block to coincide with the reference and aiming directions in a manner which does not vary with the orientation of the aiming block; and means for sending a portion of the radiation emitted by the collimator means to the localization means after passing through the harmonization means, together with means for simultaneously sending a portion of the radiation emitted by the designator means to the localization means, in such a manner that during a setting-up phase the localization means are capable of delivering a harmonization signal representative of the angular difference between the localization direction and the collimation direction.

A first advantage which stems from this arrangement lies in the decoupling thus provided between the aiming block which is a self-contained optical assembly and the distance-measuring/angle-measuring/harmonization assembly which is an essentially electronic assembly, without thereby modifying the harmonization of the assembly. It is thus relatively easy to adapt the invention to existing aiming blocks providing the harmonization means are optically and mechanically exterior thereto. In addition, it is relatively easy to interchange aiming blocks.

A second advantage lies in the two functions performed by the collimator. Firstly it performs a conventional reticle function enabling the operator to center his field of view on the target, and secondly it performs the function of a reference source for providing immediate harmonization which is integrated in the device. This is because the image of the reticle as sent to the localization means serves to define the above-mentioned "localization direction".

It may also be observed that such harmonization may be performed at any moment, without requiring a target and without requiring any return from the laser beam.

Advantageously, servocontrol means may be provided to control the harmonization means in such a manner as to cancel the harmonization signal as delivered by the localization means.

Preferably, the harmonization means include a crossed-prism deflector interposed on the optical path of the light rays at the outlet from the collimator means.

Further, a portion of the radiation emitted by the collimator means and sent to the localization means is preferably formed by the image of a pair of point sources at a predetermined angle apart, thereby further enabling the scale factor of the localization means to be adjusted during the setting up phase.

It is also preferable for the radiation from the illumination means and from the point sources in the collimator to occupy a band of the spectrum which is not visible to the operator, with the image of the reticle being emitted, in contrast, in a visible portion of the spectrum.

The above-mentioned two functions performed by the collimator means are thus performed in two different regions of the spectrum; harmonization takes place in an invisible infrared portion which additionally corresponds to the emitted laser radiation and to improved sensitivity of the localization means; and the aiming reticle is performed using visible light, thereby avoiding the danger of interfering with the harmonization process.

BRIEF DESCRIPTION OF THE DRAWING

An embodiment of the invention is described by way of example with reference to the sole FIGURE of the accompanying drawing which is a diagrammatic representation of one embodiment of the invention.

MORE DETAILED DESCRIPTION

The FIGURE shows a laser telemeter 100 delivering a telemetry signal ST, a localization assembly 200, suitable for providing an angle signal SE, an aiming block 300 which constitutes an optical invariant, a collimator 400 for forming the reticle and the point sources, together with harmonization means 500.

The telemeter 100 includes afocal optics 110, an outlet comprising a designator means window 111 for emitting a monochromatic beam along an emission axis, and an inlet window 112 for analyzing said beam after reflection on a target.

The localization module 200 includes an inlet window 210 which enables two beams to illuminate a flying spot cathode tube (or similar device such as a charge transfer device, for example). The angle-measuring means includes a computer circuit 220 which then determines, on the basis of the information applied thereto, the angle between the propagation directions of the two beams striking the window 210.

In the example shown, the aiming block 300 is a periscope block comprising a frame 310 topped by a pivoting cap 320 which supports a gyro-stabilized mirror 370. The cap and the mirror are servocontrolled in such a manner as to move together under operator control.

The aiming block includes an outlet window 330 transmitting a visible image of the target to the operator and situated in front of another window 340 which also transmits to the operator, and serves to transmit a superposed image of a reticle formed by the collimator 400. A window 350 near the bottom of the block serves to transmit (infrared) radiation from the telemeter 100 together with the radiation emitted by the projectile tracer. This radiation is directed towards the localization means 200.

The aiming block houses a separator prism 360 for distributing or bringing together the various beams between the windows of the aiming block.

More precisely, the following optical paths are shown: the visible image of the target as relayed to the operator follows a path $A_1$ $B_1$ $C_1$ $D_1$ (with the point $C_1$ corresponding to a reflection on a dichroic face 361 which reflects visible radiation but which allows infrared radiation to pass therethrough);

a monochromatic beam emitted by the telemeter 100 towards the target: following a path $E_2$ $F_2$ $G_2$ $B_2$ $A_2$: the lines $A_1$ $B_1$ (aiming direction) and $A_2$ $B_2$ (reference direction) have been shown distinct for the purpose of clarity in the figure, but in reality they are coincident as is the direction $A_4$ $B_4$ (the laser return direction) as is explained below; and reception of the beam reflected from the target in response to laser emission by the telemeter: the path follows $A_4$ $B_4$ $G_4$ $E_4$ (returning towards the telemeter window 112).

The separator and deflector assembly constituted by the semi-reflective dichroic mirror 230 and the prism 240 is supported by a single body 250 which enables these various optical componnts to be properly aligned, which components are the optical components associated with the localized-telemeter assembly independently of the aiming optical block per se. An interchangeable subassembly is thus available which behaves as an optical invariant and which therefore does not need to be accurately placed relative to the electronic detectors (the telemeter and the localization means).

This subassembly also includes a return reflector 540, an attenuator 530 and an optical square 520 which is used for harmonization and whose role is described below.

Radiation emitted by the tracer from the projectile fired at the target follows the path $A_5$ $B_5$ $G_5$ $F_5$ $J_5$ $K_5$. The localization means generates an angle signal relating to the angle between the projectile and the target on the basis of the difference between the points K6 (radiation from the collimator) and $K_5$ (radiation from the projectile).

As mentioned above, the collimator means 400 provides two functions, firstly it forms the aiming reticle in visible light, and secondly it generates a point source for harmonization purposes in infrared light. These two items are formed on a single reticle glass 422 but they are arranged to radiate in different portions of the spectrum. The visible illumination is provided by a halogen lamp 410 with an anti-heat and spectral shaping filter 411 and a condenser 412. In contrast, the reticle points used for harmonization are illuminated by means of a light-emitting diode (LED) 420 which emits infrared light that is conveyed to the corresponding zone of the reticle by a bundle of optical fibers 421. Finally, an objective lens 430 is placed at the outlet from the collimator.

The harmonization means 500 is constituted by a crossedprism deflector situated at the outlet from the collimator and which serves to deviate the light rays coming therefrom to a small extent so as to make them parallel to the emission axis of the laser beam. The crossed-prism deflector is constituted by two prisms 501, 502 having a very small apex angle and each of which is provided with an electric motor 511, 512 under servocontrol 550. The motors are operated as a function of a harmonization signal (SH) delivered by the localization means during a prior setting-up phase.

Harmonization uses the following optical paths: taking a very small fraction (less than 1 ppm) of the emitted laser radiation to illuminate: a path $E_2 F_2 H_3 I_3 J_3 K_3$, by reflection at the cube corner 540 via the attenuator 550. This provides a point $K_3$ on the localization means representative of the reference direction;

image of the reference points emitted in infrared light by collimator 400: using $L_6 M_6 N_6 F_6 J_6 K_6$, via the optical square 520. This thus provides a second point $K_6$ on the localization means representative of the collimation direction since the signal is taken from the output of the crossed-prism deflector 500;

visible reticle is sent to the operator over a path $L_7 O_7 D_7$. It may be observed (and this is one of the essential features of the invention) that insofar as there is only one reticle glass 422 and the radiation for harmonization is taken at the output from the crossed-prism deflector, any angular variation in the direction $O_7 D_7$ (i.e. in the apparent aiming direction) gives rise to a simultaneous modification in the direction $J_6 K_6$.

Then it is only necessary to adjust the crossed-prism deflector so that the points $K_6$ and $K_3$ are coincident, i.e. so that the direction $O_7 D_7$ (the apparent aiming direction) and the direction $C_1 D_1$ (the real aiming direction or reference direction) coincide.

This adjustment may be performed automatically by servo-control 550 controlling the motors 511 and 512 of the crossed-prism deflector, in such a manner as to cancel the harmonization signal SH delivered by the localization means.

It may be observed that the optical paths marked with the letters having the indices 3 and 6 (i.e. the paths used for harmonization) are completely internal to the apparatus. They therefore do not require a reference target to be illuminated in order for harmonization to be performed, and they never pass through the optical block 300, which is therefore an optical invariant external to the system, thereby making it readily interchangeable.

We claim:

1. A optical aiming assembly for designating and tracking a target the assembly being of the type comprising:

designator means suitable for emitting monochromatic radiation along a reference direction towards a designated target;

an aiming block enabling the target to be observed by an operator along an aiming direction coinciding with the reference direction, and orientable in such a manner as to simultaneously modify said directions to direct them to a target;

collimator means suitable for forming a visible image of a reticle indicative of the aiming direction and for sending said image to the aiming block, in a collimation direction representative of the aiming direction; and localization means suitable for receiving firstly a signal representative of the direction to the target along a localization direction, and secondly radiation emitted by a projectile fired towards the target, and for comparing the respective propagation directions to derive an angle signal relating to the projectile and to the target;

wherein the optical aiming assembly further comprises:

harmonization means interposed between the collimator means and the aiming block and suitable for adjusting the angular orientation of the collimation direction in such a manner as to cause the collimation direction at the outlet from the aiming block to coincide with the reference and aiming directions in a manner which does not vary with the orientation of the aiming block; and means for sending a portion of the radiation emitted by the collimator means to the localization means after passing through the harmonization means, together with means for simultaneously sending a portion of the radiation emitted by the designator means to the localization means, in such a manner that during a setting-up phase the localization means are capable of delivering a harmonization signal representative of the angular difference between the localization direction and the collimation direction.

2. An assembly according to claim 1 further including servo-control means for controlling the harmonization means in such a manner as to cancel the harmonization signal delivered by the localization means.

3. An assembly according to claim 1, wherein the harmonization means include a crossed-prism deflector interposed on the optical path of the light rays at the outlet from the collimator means.

* * * * *